US008181638B1

(12) United States Patent
Yehle

(10) Patent No.: US 8,181,638 B1
(45) Date of Patent: May 22, 2012

(54) ECCENTRIC POWER CABLE LET-OUT MECHANISM FOR A COMPOUND ARCHERY BOW

(76) Inventor: Craig T. Yehle, Junction City, OR (US)

( * ) Notice: Subject to any disclaimer, the term of this patent is extended or adjusted under 35 U.S.C. 154(b) by 311 days.

(21) Appl. No.: 12/690,783

(22) Filed: Jan. 20, 2010

(51) Int. Cl.
*F41B 5/10* (2006.01)

(52) U.S. Cl. ..... 124/25.6

(58) Field of Classification Search ..... 124/23.1, 124/25.6, 86, 88, 900
See application file for complete search history.

(56) References Cited

U.S. PATENT DOCUMENTS

| | | | | |
|---|---|---|---|---|
| 3,990,425 | A | 11/1976 | Ketchum | |
| 4,300,521 | A | 11/1981 | Schmitt | |
| 4,440,142 | A | 4/1984 | Simonds | |
| 4,546,754 | A | 10/1985 | Smith | |
| 4,686,955 | A | 8/1987 | Larson | |
| 4,733,648 | A | 3/1988 | Martin | |
| 4,781,167 | A | 11/1988 | Martin | |
| 4,909,231 | A | 3/1990 | Larson | |
| 5,368,006 | A | 11/1994 | McPherson | |
| 5,381,777 | A | 1/1995 | Mitchell et al. | |
| 5,390,655 | A | 2/1995 | Mitchell et al. | |
| 5,623,915 | A | 4/1997 | Kudlacek | |
| 5,687,703 | A * | 11/1997 | Vyprachticky | 124/25.6 |
| 5,697,355 | A * | 12/1997 | Schaffer | 124/25.6 |
| 5,890,480 | A | 4/1999 | McPherson | |
| 6,237,582 | B1 | 5/2001 | McPherson | |
| 6,474,324 | B1 | 11/2002 | Despart et al. | |
| 6,659,096 | B1 | 12/2003 | Nealy et al. | |
| 6,792,930 | B1 | 9/2004 | Kronengold et al. | |
| 6,871,643 | B2 | 3/2005 | Cooper et al. | |
| 6,990,970 | B1 | 1/2006 | Darlington | |
| 7,188,615 | B2 * | 3/2007 | Chang | 124/25.6 |
| 7,305,979 | B1 | 12/2007 | Yehle | |
| 7,441,555 | B1 * | 10/2008 | Larson | 124/25.6 |

OTHER PUBLICATIONS

U.S. Appl. No. 12/511,085, filed Jul. 29, 2009, Yehle.
Krenz, Bill: "Mathews McPherson Series Monster"; Inside Archery (Jun. 2009; p. 30); http://mathewsinc.com/data/mathewsinc/file/245_45289_Mathews%20Monster_2.pdf.
Silks, Jon E.; "Mathews McPherson Series Monster"; Bowhunting (Aug. 2009; p. 18); http://mathewsinc.com/data/mathewsinc/file/245_45293_BOWP-090800-HGM.pdf.
Bell, Joe; "Mathews McPherson Series Monster"; Bow & Arrow Hunting (believed published in 2009); http://mathewsinc.com/data/mathewsinc/file/245_44981_BOW_4.pdf.
Hartle, Luke L.; ". . . And Then There Were Two"; North American Hunter (believed published in 2009); http://mathewsinc.com/data/mathewsinc/file/245_44305_NorAmerHunterMathews2009NewProducts.pdf.

(Continued)

*Primary Examiner* — John Ricci
(74) *Attorney, Agent, or Firm* — David S. Alavi

(57) ABSTRACT

A compound archery bow comprises a riser and two limbs extending therefrom; first and second pulley members on the corresponding limbs; a draw cable, and a power cable. The pulley members include corresponding draw cable journals, and the draw cable is engaged to be let out from them and to rotate the pulley members as the bow is drawn. The first and second pulley members further include power cable take-up and let-out mechanisms, respectively. The power cable is engaged to be taken up by the power cable take-up mechanism and to be let out by the power cable let-out mechanism as the bow is drawn and the pulley members rotate. The power cable let-out mechanism comprises paired let-out members disposed on opposite sides of the second bow limb, and the power cable is engaged with the let-out members in a split cable arrangement or a yoke arrangement.

36 Claims, 11 Drawing Sheets

OTHER PUBLICATIONS

Murray, Jeff; Mathews is Unbearish for 2009; Bear Hunting Magazine (Jan./Feb. 2009); http://mathewsinc.com/data/mathewsinc/file/245_44237_Mathews-Murray.pdf.

Mathews, Inc.; magazine ad copy (believed published in 2009); http://mathewsinc.com/data/mathewsinc/file/245_44993_monster_full-boww-Irz.pdf.

* cited by examiner

ECCENTRIC POWER CABLE LET-OUT MECHANISM FOR A COMPOUND ARCHERY BOW

BACKGROUND

The field of the present invention relates to archery bows. In particular, a compound archery bow is described herein wherein a power cable is simultaneously taken up at one end and let out at the other using an eccentric let-out mechanism.

For purposes of the present disclosure and appended claims, the terms "compound archery bow" or "compound bow" shall denote an archery bow that uses a levering system, usually comprising one or more cables and pulleys, to bend the limbs as the bow is drawn. Examples of compound bows include dual-cam bows (including those that employ a Binary Cam System®), hybrid-cam bows, or single-cam bows. Many compound archery bows typically include one or more power cables (sometimes referred to as buss cables or anchor cables). Conventionally, each power cable is engaged at its first end to be taken up by a power cam (or other take-up mechanism) of a pulley member rotatably mounted on one bow limb, and is coupled at its second end to the other bow limb. Tension developed as the bow is drawn and the power cable is taken up causes deformation of the bow limbs and storage of potential energy therein. A portion of that potential energy is transformed into the kinetic energy of the arrow shot by the bow. A few examples of various compound bow types are disclosed in the following patents and application, all of which are incorporated by reference as if fully set forth herein:

U.S. Pat. No. 3,990,425 entitled "Compound bow" issued Nov. 9, 1976 to Ketchum;

U.S. Pat. No. 4,686,955 entitled "Compound archery bows" issued Aug. 18, 1987 to Larson;

U.S. Pat. No. 5,368,006 entitled "Dual-feed single-cam compound bow" issued Nov. 29, 1994 to McPherson;

U.S. Pat. No. 6,871,643 entitled "Eccentric elements for a compound archery bow" issued Mar. 29, 2005 to Cooper et al;

U.S. Pat. No. 6,990,970 entitled "Compound archery bow" issued Jan. 31, 2006 to Darlington;

U.S. Pat. No. 7,305,979 entitled "Dual-cam archery bow with simultaneous power cable take-up and let-out" issued Dec. 11, 2007 to Yehle;

U.S. Pat. No. 7,441,555 entitled "Synchronized compound archery bow" issued Oct. 28, 2008 to Larson; and U.S. non-provisional application Ser. No. 12/511,085 entitled "Pulley-and-cable power cable tensioning mechanism for a compound archery bow" filed Jul. 29, 2009 in the name of Craig T. Yehle.

In some single-cam, dual-cam, and hybrid-cam compound bows, the power cable is connected at its second end directly to a bow limb or to an axle on which a pulley member is mounted on the bow limb. Such a direct connection can include a split power cable arrangement (wherein the second end of the power cable is divided into two discrete end segments each secured to the limb or axle) or a yoke arrangement (wherein the power cable is attached to a yoke member that is in turn attached to the limb or axle by two yoke cables or by a single looped yoke cable). If a yoke arrangement is employed, the yoke cable(s) can be secured on opposite sides of a pulley member between the pulley member and the limb, or on opposite sides of the limb. If secured between the pulley member and the limb, the spacing provided by the yoke enables rotation of the pulley member without interference from the yoke cable(s). If a split power cable arrangement is employed, the discrete end segments of the split power cable are often secured on opposite sides of the limb to enable rotation of the pulley member without interference from the power cable end segments, but can in some instances be secured between the pulley member and the limb.

Examples of a yoke arrangement for a compound bow cable are disclosed in the following patents, all of which are incorporated by reference as if fully set forth herein:

U.S. Pat. No. 4,330,521 entitled "Compound bow" issued Nov. 17, 1981 to Schmitt;

U.S. Pat. No. 4,440,142 entitled "Compound bow cable tension adjuster" issued Apr. 3, 1984 to Simonds;

U.S. Pat. No. 4,546,754 entitled "Yoke anchor for a compound bow" issued Oct. 15, 1985 to Smith;

U.S. Pat. No. 4,733,648 entitled "Compound bow cable anchor" issued Mar. 29, 1988 to Martin;

U.S. Pat. No. 4,781,167 entitled "Compound bow with adjustable tension cable anchor" issued Nov. 1, 1988 to Martin;

U.S. Pat. No. 4,909,231 entitled "Dual anchor cable separator for compound bows" issued Mar. 20, 1990 to Larson.

U.S. Pat. No. 5,381,777 entitled "Compound bow and yoke adjuster" issued Jan. 17, 1995 to Mitchell et al.

Examples of a split power cable arrangement for a compound bow are disclosed in the following patents, all of which are incorporated by reference as if fully set forth herein:

U.S. Pat. No. 5,390,655 entitled "Compound bow and cable mounting bracket" issued Feb. 21, 1995 to Mitchell et al;

U.S. Pat. No. 5,623,915 entitled "Archery bowstring system" issued Apr. 29, 1997 to Kudlacek;

U.S. Pat. No. 5,890,480 entitled "Dual-feed single-cam compound bow" issued Apr. 6, 1999 to McPherson;

U.S. Pat. No. 6,237,582 entitled "Archery bow with bow string coplanar with the longitudinal axis of the bow handle" issued May 29, 2001 to McPherson;

U.S. Pat. No. 6,474,324 entitled "Archery bows, archery bow cam assemblies, and archery bow anchors" issued Nov. 5, 2002 to Despart et al;

U.S. Pat. No. 6,659,096 entitled "Split-buss-cable single-cam compound archery bow" issued Dec. 9, 2003 to Nealy et al; and U.S. Pat. No. 6,792,930 entitled "Single-cam split-harness compound bow" issued Sep. 21, 2004 to Kronengold et al.

Some compound bows include a mechanism on the bow limb for letting out the second end of the power cable. For example, bows disclosed in U.S. Pat. No. 3,990,425, U.S. Pat. No. 6,990,970, U.S. Pat. No. 7,305,979, and U.S. Pat. No. 7,441,555 include on a pulley member a journaled wheel (concentric or eccentric), a series of posts (from which the power cable unwinds), or an eccentrically located power cable attachment point. In some examples the second end (i.e., the let-out end) of the power cable directly engages the let out mechanism of the pulley member (as in FIGS. 1 and 2). In other examples the second end of the power cable is coupled to paired let-out mechanisms on opposite sides of the pulley member between the pulley member and the limb through a yoke or split-cable arrangement (as in FIGS. 3 and 4). The McPherson Series® Monster™ compound bow incorporates paired eccentrically located power cable attachment points (that include rotating-bearings) on the opposite sides of the pulley member between the pulley member and the bow limb, with a yoke arrangement coupling the second end of each power cable to the power cable attachment points.

An exemplary prior art dual-cam archery bow 20 (in this example employing a Binary Cam System®) is illustrated schematically in FIGS. 1 and 2. Bow limbs 211*a* and 211*b* extend oppositely from handle 210. Pulley members (i.e., cam assemblies) 230*a* and 230*b* are rotatably mounted on respective limbs 211*a* and 211*b* on respective axles 212*a* and 212*b*. Draw cable 240 is secured at each end to the cam assemblies 230*a* and 230*b* and received in respective draw cable journals 232*a* and 232*b* thereof. When the bow is drawn, the draw cable unwinds from the draw cable journals, thereby rotating the cam assemblies. A first power cable 245*a* is secured to the first cam assembly 230*a* and engaged with a power cable take-up journal 234*a* thereof, so that as the bow is drawn and the cam assembly 230*a* rotates, the power cable 245*a* is taken up by power cable take-up journal 234*a* of cam assembly 230*a*. The other end of power cable 245*a* is secured to cam assembly 230*b* and engaged with a power cable let-out journal 236*b* thereof, so that as the bow is drawn and cam assembly 230*b* rotates, power cable 245*a* is let out by power cable let-out journal 236*b* of cam assembly 230*b*. In an analogous fashion, power cable 245*b* is secured at one end to cam assembly 230*b*, engaged with a power cable take-up journal 234*b* thereof, and is taken up when the bow is drawn, while its other end is secured to cam assembly 230*a*, engaged with a power cable let-out journal 236*a* thereof, and is let out when the bow is drawn. The power cable take-up and let-out journals are arranged so that as the bow is drawn, the bow limbs are drawn toward one another. The power cables 245*a* and 245*b* are engaged at their second ends directly with the power cable let-out journals 236*b* and 236*a*, respectively.

Another exemplary prior art dual-cam archery bow 20 (similar to the McPherson Series® Monster™) is illustrated schematically in FIGS. 3 and 4. In this example the second end of the power cable 245*a* is coupled to paired, eccentrically located power cable attachment bearings 237*a* on the first cam assembly 230*a* by yoke cable 238*a* and yoke 239*a*. The second end of the power cable 235*b* is likewise coupled to power cable attachment bearings 237*b* on the second cam assembly 230*b* by yoke cable 238*b* and yoke 239*b*. The yoke cables 238*a/b* are secured to the attachment bearings 237*a/b* on opposite sides of the pulley members 230*a/b*, between each pulley member 230*a/b* and the corresponding bow limb 211*a/b*.

SUMMARY

A compound archery bow comprises a substantially rigid riser with first and second resilient bow limbs extending from respective first and second end portions of the riser; first and second pulley members rotatably connected to the respective bow limbs; a draw cable, and a power cable. The first and second pulley members include respective first and second draw cable journals. The draw cable is engaged to be let out by the first and second draw cable journals and to rotate the first and second pulley members as the bow is drawn. The first pulley member further includes a power cable take-up mechanism, and the second pulley member further includes a power cable let-out mechanism. The power cable is (i) engaged to be taken up by the power cable take-up mechanism as the bow is drawn and the first pulley member rotates and (ii) engaged to be let out by the power cable let-out mechanism as the bow is drawn and the second pulley member rotates. The power cable let-out mechanism comprises paired let-out members disposed on opposite sides of the second bow limb, and the power cable is engaged with the power cable let-out mechanism in a split cable arrangement or a yoke arrangement engaged with the paired let-out members on opposite sides of the second bow limb.

Objects and advantages pertaining to compound archery bows may become apparent upon referring to the exemplary embodiments illustrated in the drawings and disclosed in the following written description or claims.

The embodiments shown in the Figures are exemplary, and should not be construed as limiting the scope of the present disclosure or appended claims. The Figures may illustrate the exemplary embodiments in a schematic fashion, and various shapes, sizes, angles, curves, proportions, and so forth may be distorted to facilitate illustration. The specific shapes, sizes, angles, curves, proportions, etc should not be construed as limiting the scope of the present disclosure or appended claims.

DETAILED DESCRIPTION OF EMBODIMENTS

Figure 1:
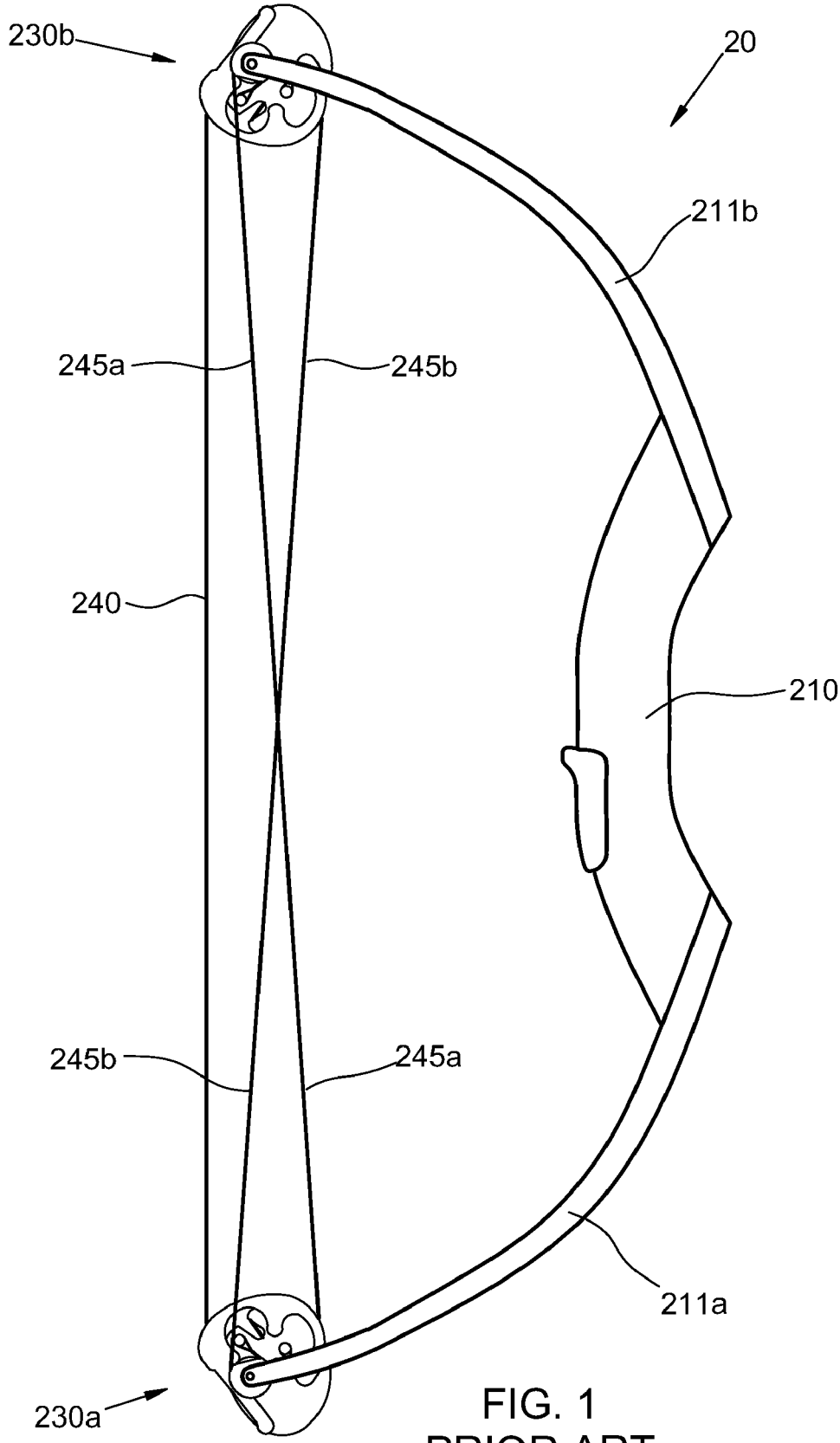
FIG. 1 PRIOR ART
FIG. 1 illustrates schematically a prior art compound archery bow.
Figure 2:
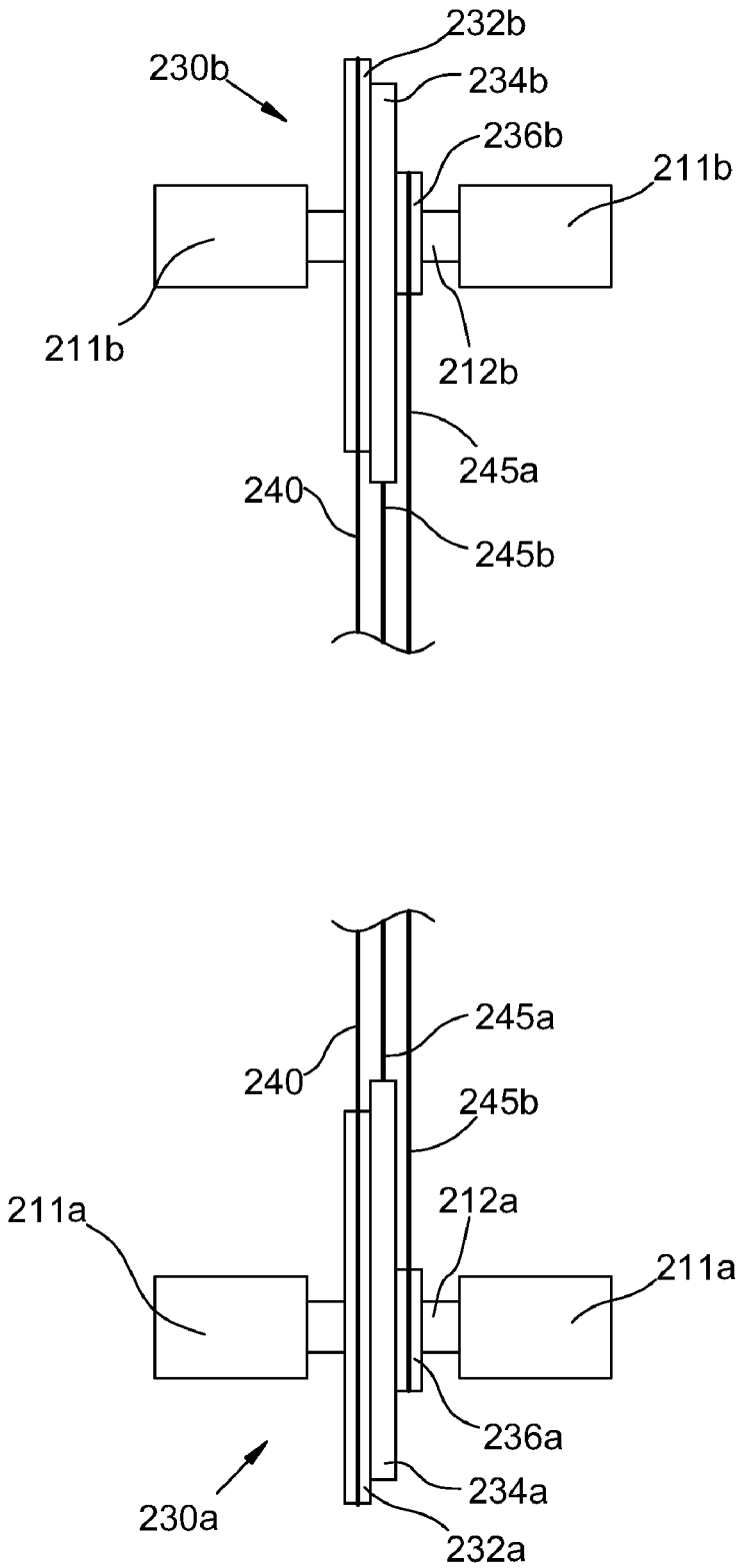
FIG. 2 PRIOR ART
FIG. 2 is a schematic back view of the cables and pulley members of the bow of FIG. 1.
Figure 3:
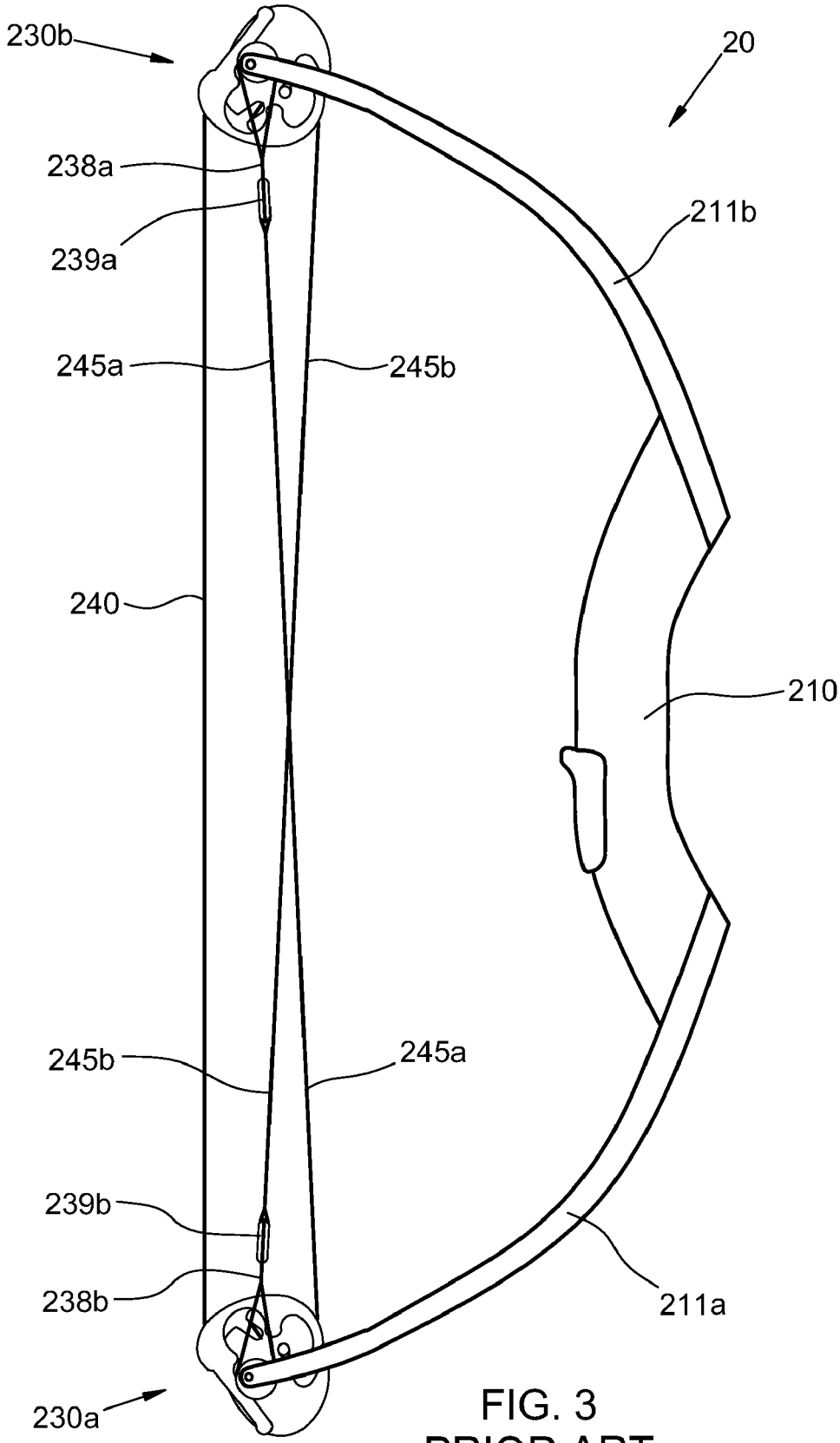
FIG. 3 PRIOR ART
FIG. 3 illustrates schematically another prior art compound archery bow.
Figure 4:
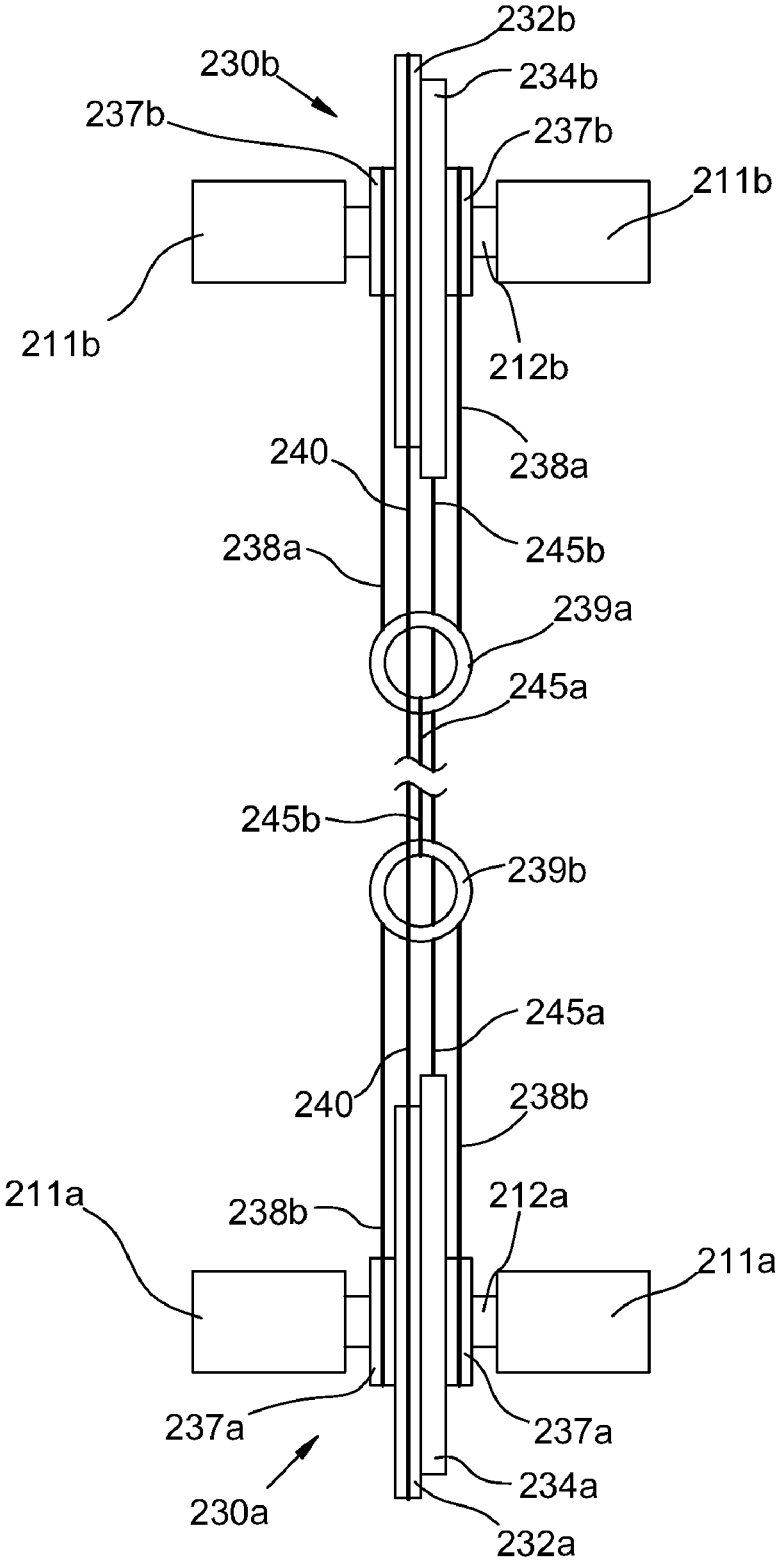
FIG. 4 PRIOR ART
FIG. 4 is a schematic back view of the cables and pulley members of the bow of FIG. 3.
Figure 5:
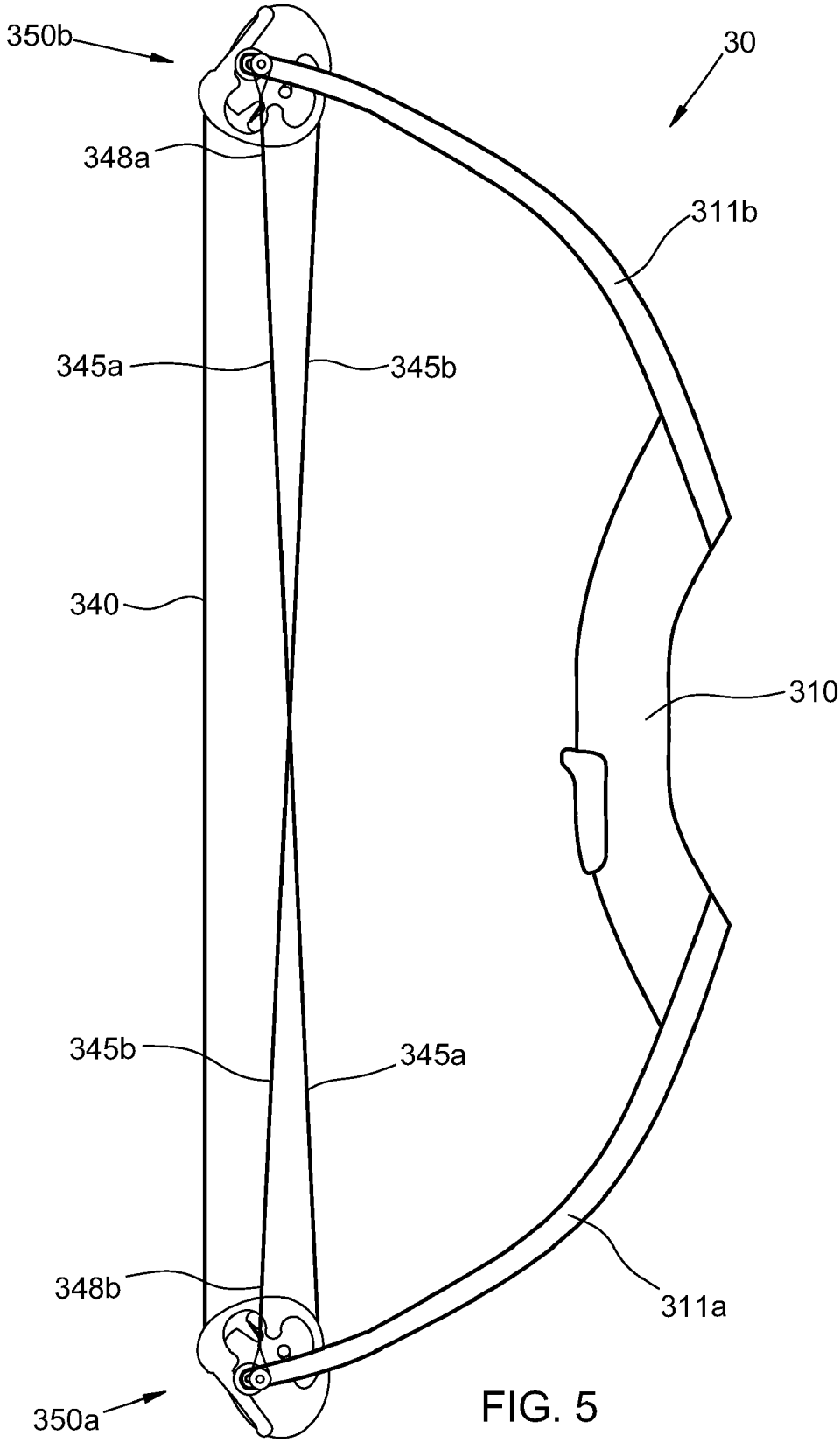
FIG. 5 illustrates schematically an exemplary compound archery bow.
Figure 6:
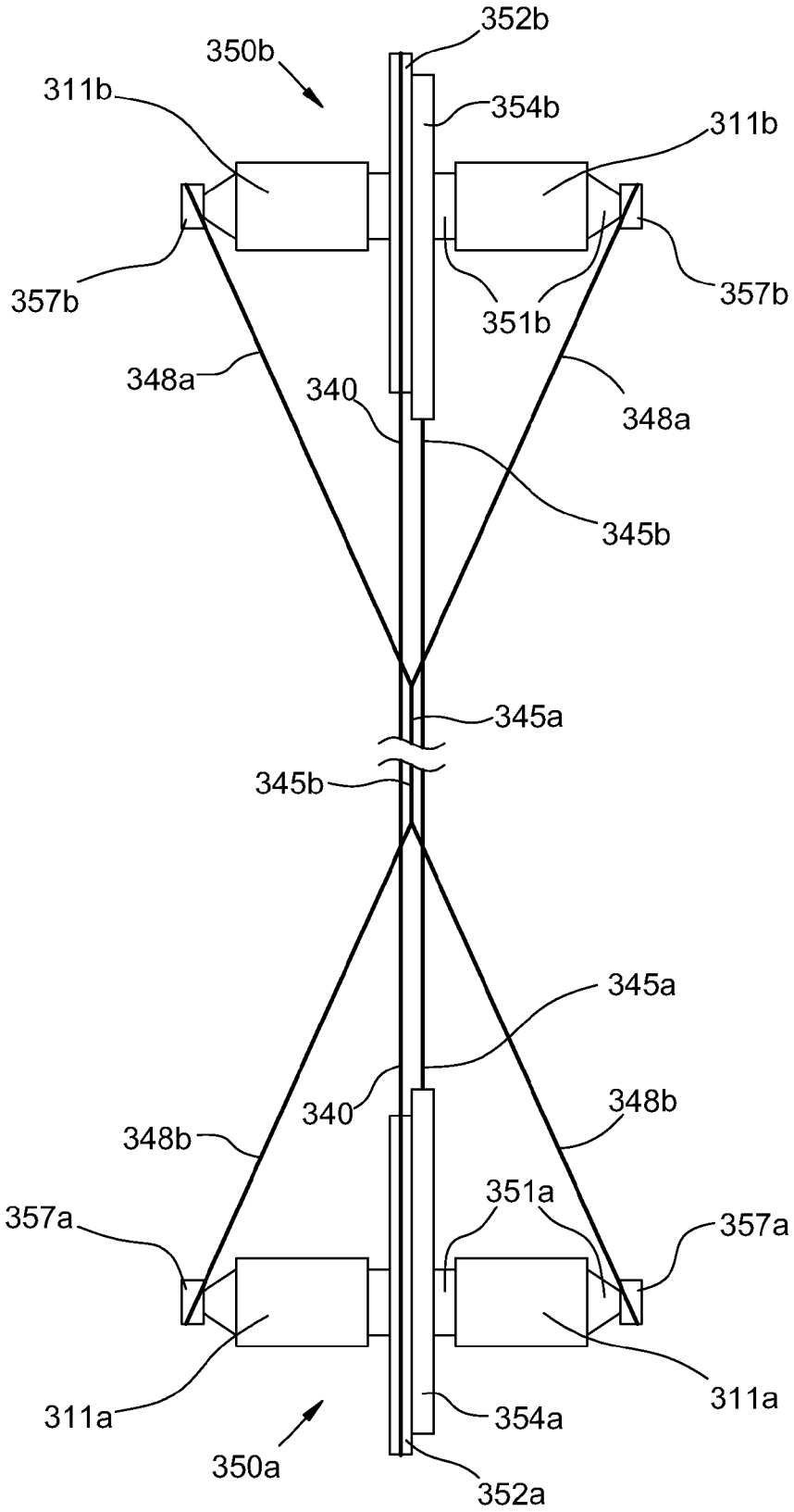
FIG. 6 is a schematic back view of the cables and pulley members of the bow of FIG. 5.
Figure 8:
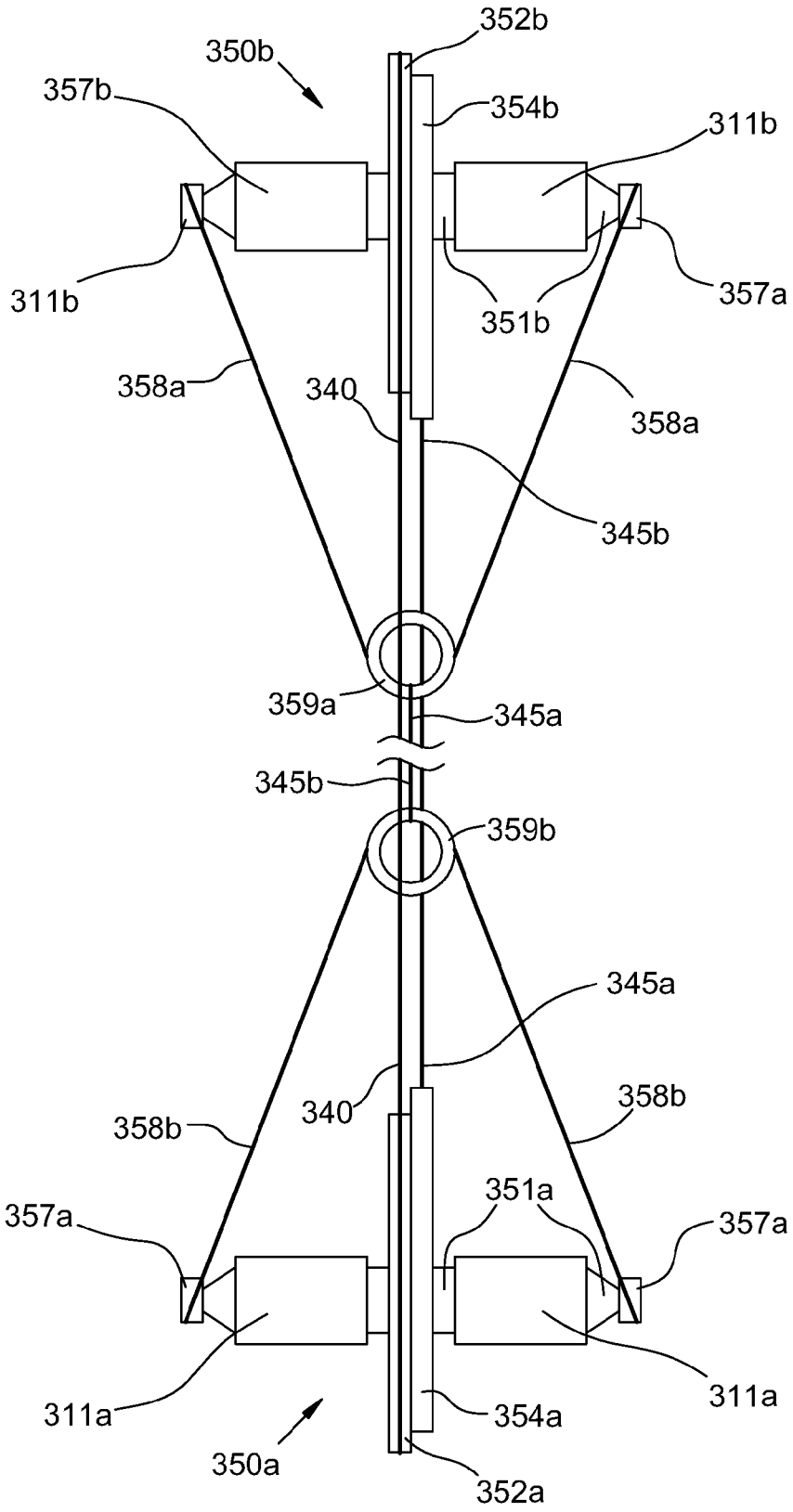
FIG. 8 is a schematic back view of the cables and pulley members of the bow of FIG. 7.
Figure 9A:
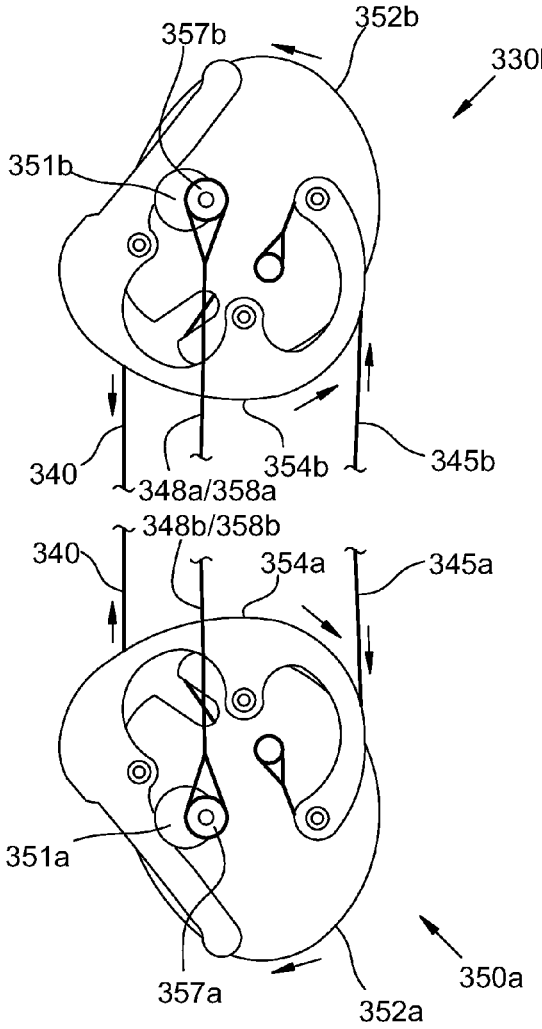
FIGS. 9*a* and 9B are side views of the cables and pulley members of the bows of FIG. 5 or FIG. 7 at brace and at full draw, respectively.
Figure 9B:
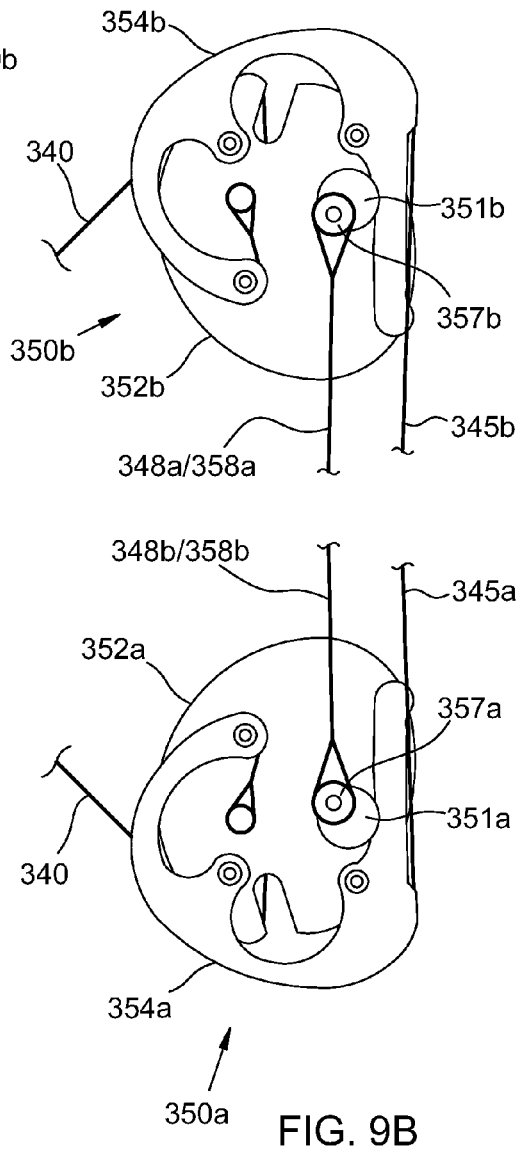

An exemplary compound archery bow 30 is illustrated schematically in FIG. 5; the corresponding pulley members 350*a* and 350*b* (e.g., cam assemblies) are shown enlarged in FIGS. 6, 9A, and 9B. Another exemplary compound archery bow 30 is illustrated schematically in FIG. 7; the corresponding pulley members 350*a* and 350*b* are shown enlarged in FIGS. 8, 9A, and 9B. Although the exemplary bows are dual-cam compound bows with two power cables (each with corresponding take-up and let-out mechanisms), any compound bow with one or more power cables can fall within the scope of the present disclosure or appended claims. Bow limbs 311*a* and 311*b* extend oppositely from handle 310. Pulley members 350*a* and 350*b* are connected to respective limbs 311*a* and 311*b* to rotate about respective rotation axes. Both eccentrically and concentrically mounted pulleys or cams shall fall within the scope of the present disclosure or appended claims. In a dual-cam compound bow the pulley members 350*a/b* are typically substantial mirror images of one another or substantially identical to one another (i.e., symmetric cams), though this need not always be the case. Both symmetric and asymmetric embodiments shall fall within the scope of the present disclosure or appended claims. Draw cable 340 is engaged with the pulley members 350*a*/350*b* and received in respective draw cable journals 352*a*/352*b* thereof. When the bow is drawn, the draw cable 340 unwinds from the draw cable journals 352*a*/352*b*, thereby rotating the pulley members 350*a*/350*b*.

A first power cable 345*a* is engaged to be taken up by a power cable take-up mechanism of pulley member 350*a* as the bow 30 is drawn and the pulley member 350*a* rotates, and is engaged to be let out (during at least a latter portion of drawing the bow) by a power cable let-out mechanism of pulley member 350*b* as the bow 30 is drawn and the pulley member 350*b* rotates. In the examples shown, the power cable take-up mechanism of pulley members 350*a* and 350*b* are eccentric power cable take-up journals 354*a* and 354*b*, respectively. Any suitable take-up mechanism (e.g., a concentric or eccentric journal, a series of posts onto which the power cable is wound, or an eccentrically positioned power cable anchor) can be employed within the scope of the present disclosure or appended claims). The power cable take-up and let-out mechanisms of pulley members 350*a*/350*b* are arranged so that as the bow 30 is drawn, tension developed in power cable 345*a* draws the limbs 311*a*/311*b* toward one another. In an analogous fashion (in the dual-cam bows of FIGS. 5 through 9A/9B), power cable 345*b* is engaged to be taken up by a power cable take-up mechanism of pulley member 350*b* as the bow 30 is drawn and the pulley member 350*b* rotates, and is engaged to be let out (during at least a latter portion of drawing the bow) by a power cable let-out mechanism of pulley member 350*a* as the bow 30 is drawn and the pulley member 350*a* rotates.

The draw force versus draw distance for the bow 30 is determined at least in part by the relative rates of take-up and let-out of the power cables 345*a*/345*b*. The power cables 345*a*/345*b* are typically let out by the respective let-out mechanisms during at least a latter portion of drawing the bow. In some examples the power cables are let out over the entire drawing of the bow; in other examples the power cables can be taken up by the power cable let-out mechanisms during an initial portion of drawing the bow and let-out during a latter portion of drawing the bow. The power cables 345*a*/345*b* are typically held laterally out of the arrow path by a cable guard (not shown).

Figure 7:
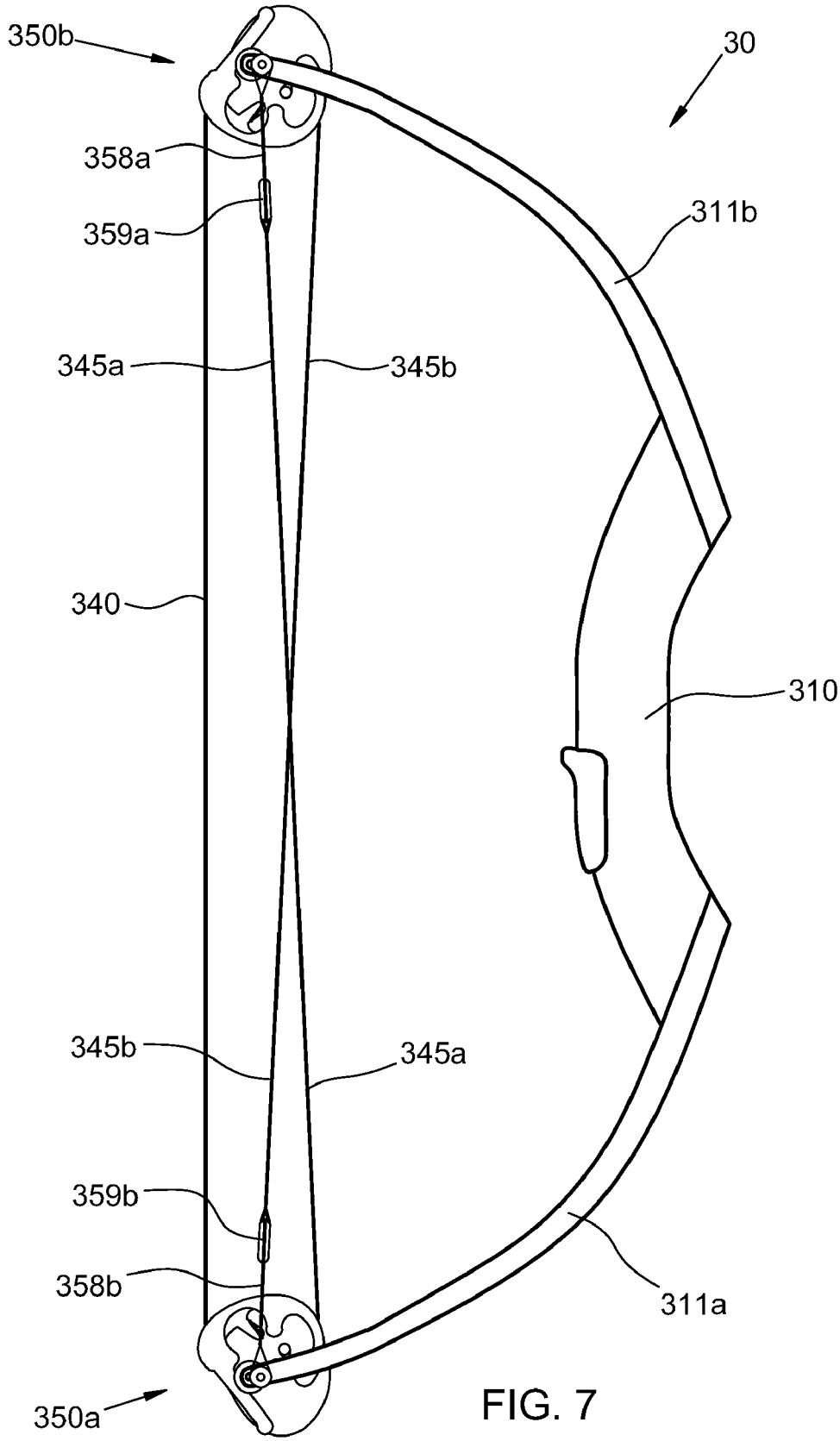
FIG. 7 illustrates schematically another exemplary compound archery bow.

The power cable let-out mechanisms comprise paired let-out members disposed on opposite sides of the corresponding bow limb. Each power cable is engaged with the corresponding power cable let-out mechanism in a split cable arrangement (FIGS. 5 and 6) or a yoke arrangement (FIGS. 7 and 8) that is engaged with the paired let-out members on opposite sides of the corresponding bow limb. In FIGS. 5 and 6, each power cable 345*a*/345*b* terminates at its let-out end in a corresponding pair of split end segments 348*a*/348*b*. The ends of the split segments 348*a*/348*b* are engaged with the paired let-out members on opposite sides of the corresponding bow limb (e.g., secured via a looped end to an eccentrically positioned cable anchor, arranged to unwrap from around one or more posts as the bow is drawn, or arranged to be let out by a concentric or eccentric power cable let-out journal). In FIGS. 7 and 8, each power cable 345*a*/345*b* is secured to a corresponding yoke 359*a*/359*b*. One or more corresponding yoke cables 359*a*/359*b* are connected to the yoke 359*a*/359*b* and are engaged with the paired let-out members on opposite sides of the corresponding bow limb (e.g., secured via a looped end to an eccentrically positioned cable anchor, arranged to unwrap from around one or more posts as the bow is drawn, or arranged to be let out by a concentric or eccentric power cable let-out journal). For each power cable 345*a*/345*b*, a single corresponding yoke cable 358*a*/358*b* can be employed by looping it around corresponding yoke 358*a*/358*b* and engaging it at each of its ends with the paired let-out members. Alternatively, two separate yoke cables 358*a*/358*b* can be employed to connect to the corresponding yoke 359*a*/359*b* and to engage each let-out member of the corresponding pair.

In the exemplary embodiments shown in FIGS. 5-8, the paired let-out members comprise a pair of power cable anchors (anchors 357*a* on pulley member 350*a*; anchors 357*b* on pulley member 350*b*) that are eccentrically positioned relative to the respective axles 351*a*/351*b* of the pulley members 350*a*/350*b* so as to let out the power cables 345*a*/345*b* over at least a latter portion of drawing the bow. The eccentric power cable anchors can be positioned so as to let-out the respective power cables 345*a*/345*b* over the entire drawing of the bow. Alternatively, as in the exemplary embodiments of FIGS. 5-8, the power cable anchors 357*a*/357*b* can be positioned so that the power cables 345*a*/345*b* are taken up during a initial portion of drawing the bow 30. At an intermediate point of drawing the bow, the cable anchors 357*a*/357*b* pass "over center," and the power cables 345*a*/345*b* are then let out by further movement of the cable anchors 357*a*/357*b* over a latter portion of drawing the bow (FIGS. 9A and 9B). The position of the power cable anchors 357*a*/357*b* (both distance and orientation) relative to the respective pulley member rotation axes defined by the axles 351*a*/351*b* determines the rate of take-up or let-out and the portions of drawing the bow 30 over which those occur. Any suitable position of the power cable anchors 357*a*/357*b* can be employed to achieve desired power cable take-up or let-out characteristics.

The axles 351*a*/351*b* are arranged to rotatably connect the respective pulley member 350*a*/350*b* to the respective bow limbs 311*a*/311*b*. Each axle can be further arranged along an intermediate segment 362 to non-rotatably engage the corresponding draw cable journal 352*a*/352*b* and arranged at its ends to serve as the corresponding pair of eccentrically positioned power cable anchors 357*a*/357*b*. In the examples shown in FIGS. 10A-10C and 11A-11C the intermediate portion 362 of the axles is provided with longitudinal splines arranged to engage a mating set of longitudinal splines (not shown) of draw cable journals 352*a*/352*b*.

To achieve and maintain desired take-up or let-out characteristics of the pulley member 351*a*/351*b*, the corresponding axle 351*a*/351*b* or the corresponding draw cable journal 352*a*/352*b* can be indexed to non-rotatably engage one another at a selected relative angular position. In the exemplary axles illustrated in FIGS. 10A-10C and 11A-11C, one longitudinal spline 364 is missing from the intermediate segment 362 of each shaft 351*a*/351*b*. Two adjacent splines of each draw cable journal 352*a*/352*b* are fused (i.e., there is no longitudinal groove between them for receiving a corresponding spline of the axle), thereby permitting the axles 351*a*/351*b* to engage the draw cable journals 352*a*/352*b* at only one relative angular position. Any other suitable structure or mechanism can be employed for non-rotatably engaging or indexing the axles 351*a*/351*b* and the draw cable journals 352*a*/352*b*.

Figure 10A:
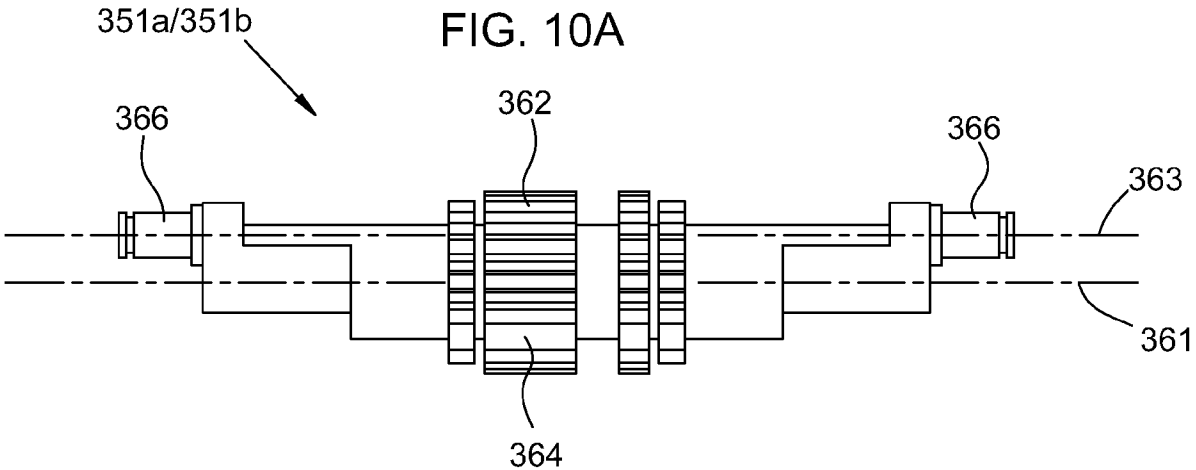
FIGS. 10A-10C illustrate schematically an exemplary axle for a pulley member.
Figure 10B:
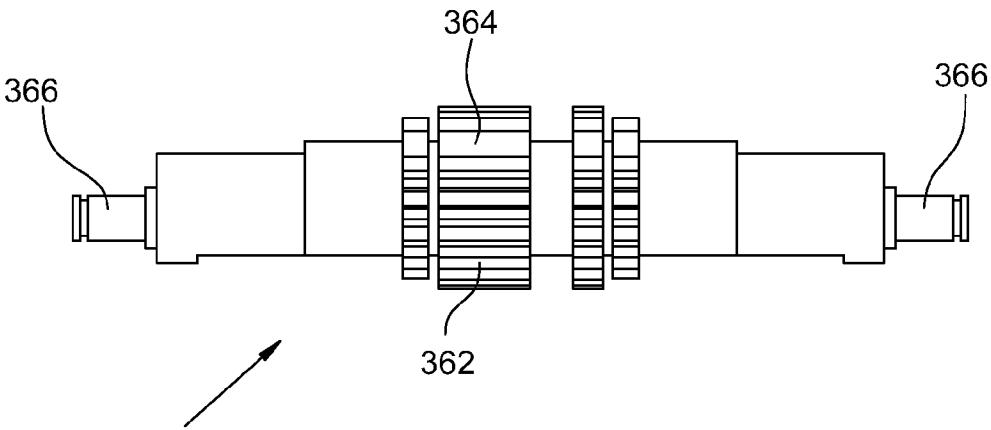
Figure 10C:
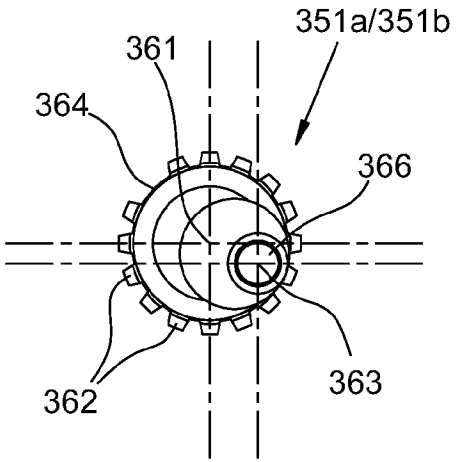
Figure 11A:
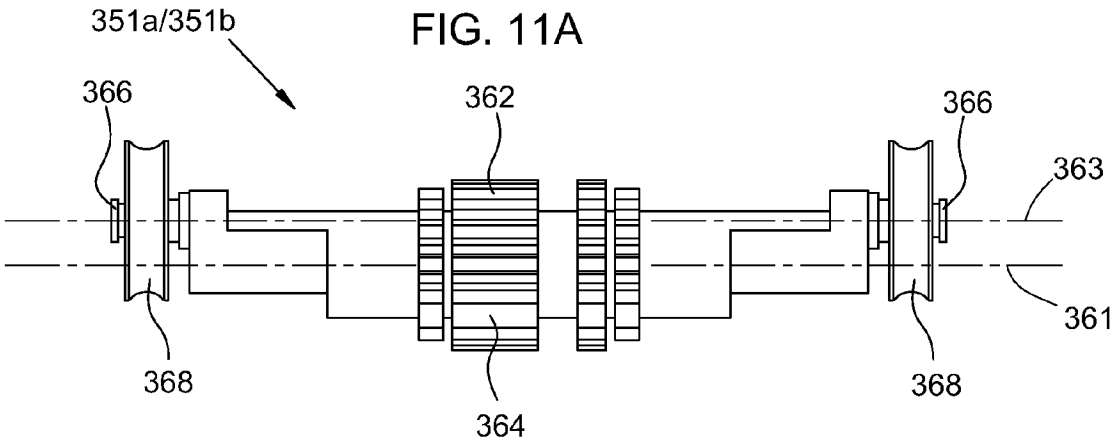
FIGS. 11A-11C illustrate schematically another exemplary axle for a pulley member.
Figure 11B:
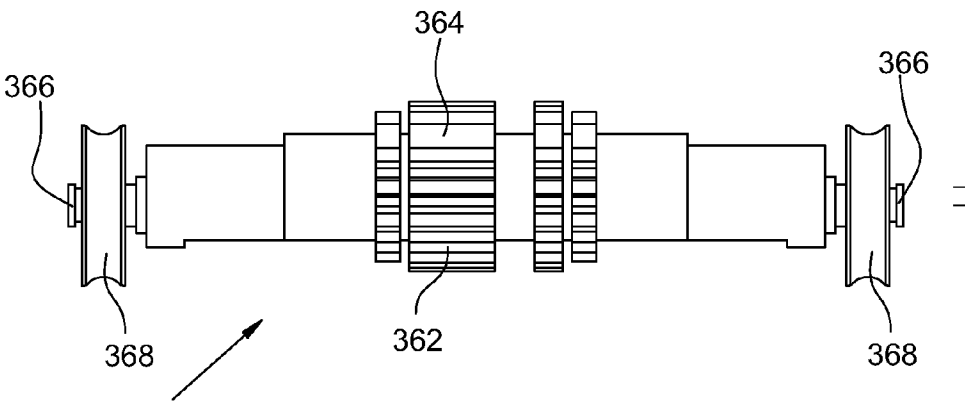
Figure 11C:
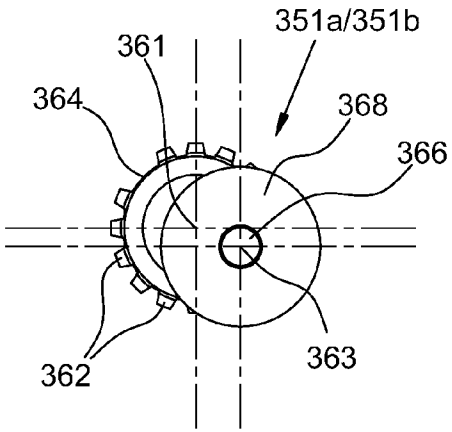

To serve as the pair of power cable anchors 357*a*/357*b*, the corresponding axle 351*a*/351*b* can be arranged in any suitable way. In the example shown in the Figures, each end of the axles 352*a*/351*b* terminates in an eccentric end portion 366. An axis 363 defined by the eccentric end portions 366 is transversely displaced relative to the rotation axis 363 defined by the axle 351*a*/351*b* for the corresponding pulley member 350*a*/350*b*. The end portions 366 of each axle 351*a*/351*b* can be grooved to receive and retain a looped end of a split power cable 348*a*/348*b* or a yoke cable 348*a*/358*b* (FIGS. 11A-11C). Alternatively, an anchor pulley 368 can be rotatably mounted on each end portion 366. The anchor pulleys 368 are grooved to receive and retain a looped end of a split power cable 348*a*/348*b* or a yoke cable 358*a*/358*b* (FIGS. 10A-10C). Rotation of the anchor pulleys 368 reduced wear of the looped portion of the power cable or yoke cable.

If a power cable is taken up at both ends it is shortened and draws the opposing bow limbs toward one another. This is the case during an initial portion of drawing the bow the exemplary power cable let-out mechanisms depicted in FIGS. 5-8, 9A-9B, 10A-10C, and 11A-11C. If a power cable is taken up at one end and let out at its other end, the difference between the rates of take-up and let-out determine whether the power cable is lengthened or shortened. An arrangement that results in lengthening of the power cable as the bow is drawn is typically avoided, because such an arrangement results in 100% let-off of the draw force (i.e., the draw cable goes limp) and the bow becomes "cocked" in the drawn position. Releasing the draw cable at this point does not shoot the arrow; instead the pulley members must be mechanically forced (preferably using a bow press for safety) back past the 100% let-off position. Note that such cocking of the bow or 100% let-off of the draw force does not occur if the power cable is taken up from both ends.

The cocked bow, 100% let-off scenario can be avoided in several ways. The instantaneous rate of take-up or let-out of a journal or other take-up or let-out mechanism is determined by its effective lever arm, which can be constant for a concentric journal or can vary for an eccentric journal or cable anchor. In one example, the pulley members can be arranged so that the effective lever arm of the power cable take-up mechanism (determined in the examples shown in the Figures by the profiles of power cable journals 354*a*/354*b*) remains larger, during let-out of the power cable, than the effective lever arm of the power cable let-out mechanism (determined in the examples shown in the Figures by the position, both distance and orientation, of the eccentric power cable anchors relative to the pulley member rotation axis). Expressed another way, the ratio of the lever arms of the power cable take-up and let-out mechanisms remains greater than 1:1 during let-out of the power cable to avoid the cocked bow, 100% let-off scenario.

Variations of the power cable take-up and let-out lever arms, along with variations in the effective lever arm of the draw cable journals 352*a*/352*b*, can be further employed to achieve desired force versus draw characteristic for the compound bow. Ratios of those lever arms can vary widely depending on the desired bow draw characteristics, and the examples that follow are not intended to be exhaustive. Any suitable ratios can be employed that yield needed or desired bow draw characteristics. A ratio at brace between a lever arm of the draw cable journals 352*a*/352*b* and a lever arm of the power cable take-up mechanisms 354*a*/354*b* can be between about 0.1:1 and about 2:1; at full draw that ratio can be between about 3:1 and about 30:1. At a point during the draw that the power cable begins to be let-out (at brace for some bows; later in the draw for other bows, including those shown in the Figures), a ratio between the lever arm of the power cable take-up mechanisms 354*a*/354*b* and a lever arm of the paired power cable let-out members 357*a*/357*b* can be greater than about 1.5:1; at full draw that ratio can be between about 1.1:1 and about 5:1. These are exemplary values that yield satisfactory bow performance, however, other values for the lever arm ratios, including values outside the exemplary ranges, can be employed while remaining within the scope of the present disclosure or appended claims.

Another arrangement for avoiding the cocked bow, 100% let-off scenario is use of a rotation stop (not shown) on one or both pulley members 350*a*/350*b*, as disclosed in, e.g., U.S. Pat. No. 7,305,979. Such a rotation stop can comprise, for example, a simple peg or other protrusion secured to the pulley member so that, upon rotation, the stop eventually comes into contact with a bow limb, the draw cable, or a power cable to hinder or prevent further rotation of the pulley member. Such a rotation stop can be secured to the respective pulley member at a position chosen to limit its rotation to a desired value. The rotation limit can be chosen for yielding a desired let-off or avoiding 100% let-off, for yielding a desired draw length, or for another purpose. The rotation stop can be integrally formed with or permanently secured to the cam assembly. Alternatively, the rotation stop can be adjustably secured to the pulley member by means of a slot or other suitable adjustable attachment.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or", "only one of . . . ", or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof shall be construed as open ended terminology, with the same meaning as if the phrase "at least" were appended after each instance thereof.

In the appended claims, if the provisions of 35 USC §112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶ 6 are not intended to be invoked for that claim.

What is claimed is:

1. A compound archery bow comprising:

a substantially rigid riser;

a first resilient bow limb extending from a first end portion of the riser;

a second resilient bow limb extending from a second end portion of the riser;

a first pulley member connected to the first bow limb and rotatable relative to the first bow limb around a first rotation axis, which first pulley member includes a first draw cable journal and a power cable take-up mechanism;

a second pulley member connected to the second bow limb and rotatable relative to the second bow limb around a second rotation axis, which second pulley member includes a second draw cable journal and a power cable let-out mechanism;

a draw cable engaged with the first and second draw cable journals and arranged to rotate the first and second pulley members as the bow is drawn and the draw cable is let out from the first and second draw cable journals; and a power cable (i) engaged to be taken up by the power cable take-up mechanism as the bow is drawn and the first pulley member rotates and (ii) engaged to be let out by the power cable let-out mechanism as the bow is drawn and the second pulley member rotates, wherein:

the power cable let-out mechanism comprises paired let-out members disposed on opposite sides of the second bow limb; and the power cable is engaged with the power cable let-out mechanism in a split cable arrangement or a yoke arrangement engaged with the paired let-out members on opposite sides of the second bow limb.

2. The bow of claim 1 wherein the power cable is engaged with the power cable let-out mechanism in a split cable arrangement wherein corresponding split end segments of the power cable are engaged with the paired let-out members on opposite sides of the second bow limb.

3. The bow of claim 1 wherein the power cable is engaged with the power cable let-out mechanism in a yoke arrangement, wherein the power cable is secured to a yoke and one or more yoke cables are connected to the yoke and engaged with the paired let-out members on opposite sides of the second bow limb.

4. The bow of claim 1 wherein the paired let-out members comprise a pair of power cable anchors that are eccentrically positioned relative to the second rotation axis so as to let out the power cable over at least a latter portion of drawing the bow.

5. The bow of claim 4 wherein the pair of power cable anchors are eccentrically positioned relative to the second rotation axis so as to take up the power cable over an initial portion of drawing the bow.

6. The bow of claim 4 wherein the second pulley member includes an axle that is (i) arranged to rotatably connect the second pulley member to the second bow limb, (ii) arranged along an intermediate segment thereof to non-rotatably engage the draw cable journal of the second pulley member and to define the second rotation axis, and (iii) arranged at its ends to serve as the pair of eccentrically positioned power cable anchors.

7. The bow of claim 6 wherein the second draw cable journal and the axle are indexed to non-rotatably engage one another at a selected relative angular position.

8. The bow of claim 6 wherein the power cable anchors comprise anchor pulleys rotatably mounted at the ends of the axle, each of which is arranged to receive and retain a corresponding looped end of a split power cable or a yoke cable.

9. The bow of claim 6 wherein the power cable anchors comprise eccentric, grooved end portions of the axle, each of which is arranged to receive and retain a corresponding looped end of a split power cable or a yoke cable.

10. The bow of claim 1 wherein:

the first pulley member includes a second power cable let-out mechanism;

the second pulley member includes a second power cable take-up mechanism;

the bow further comprises a second power cable (i) engaged to be taken up by the second power cable take-up mechanism as the bow is drawn and the second pulley member rotates and (ii) engaged to be let out by the second power cable let-out mechanism as the bow is drawn and the first pulley member rotates;

the second power cable let-out mechanism comprises corresponding paired let-out members disposed on opposite sides of the first bow limb; and the second power cable is engaged with the second power cable let-out mechanism in a split cable arrangement or a yoke arrangement engaged on opposite sides of the first bow limb with the paired let-out members.

11. The bow of claim 10 wherein the first and second pulley members are substantially identical or substantial mirror images of one another.

12. The bow of claim 1 wherein the first and second pulley members are arranged so as to avoid 100% let-off of the draw force or so as to prevent cocking of the bow.

13. The bow of claim 1 wherein the first pulley member is arranged so that a ratio between a lever arm of the power cable take-up mechanism and a lever arm of the power cable let-out mechanism remains greater than 1:1 during let-out of the power cable.

14. The bow of claim 1 wherein the power cable take-up mechanism comprises a power cable take-up journal.

15. A pulley member for a compound archery bow, the pulley member comprising:

an axle arranged to rotatably connect the pulley member to a bow limb of a compound archery bow, which axle substantially defines a rotation axis of the pulley member relative to the bow limb;

a draw cable journal non-rotatably mounted on the axle and arranged to let out a draw cable as the bow is drawn and the pulley member rotates about the rotation axis;

a power cable take-up mechanism arranged to take up a first power cable as the bow is drawn and the pulley member rotates about the rotation axis; and a power cable let-out mechanism for letting out a second power cable as the bow is drawn and the pulley member rotates about the rotation axis, wherein:

the power cable let-out mechanism comprises paired let-out members positioned on the axle so as to be disposed on opposite sides of the bow limb; and the power cable let-out mechanism is arranged so as to engage the second power cable in a split cable arrangement or a yoke arrangement engaged with the paired let-out members on opposite sides of the second bow limb.

16. The pulley member of claim 15 wherein the paired let-out members comprise a pair of power cable anchors that are eccentrically positioned relative to the rotation axis so as to let out the second power cable over at least a latter portion of drawing the bow.

17. The pulley member of claim 16 wherein the pair of power cable anchors are eccentrically positioned relative to the rotation axis so as to take up the second power cable over an initial portion of drawing the bow.

18. The pulley member of claim 16 wherein the axle is arranged at its ends to serve as the pair of eccentrically positioned power cable anchors.

19. The pulley member of claim 18 wherein the draw cable journal and the axle are indexed to non-rotatably engage one another at a selected relative angular position.

20. The pulley member of claim 18 wherein the power cable anchors comprise anchor pulleys rotatably mounted at the ends of the axle, each of which is arranged to receive and retain a corresponding looped end of a split power cable or a yoke cable.

21. The pulley member of claim 18 wherein the power cable anchors comprise eccentric, grooved end portions of the axle, each of which is arranged to receive and retain a corresponding looped end of a split power cable or a yoke cable.

22. The apparatus of claim 15 further comprising a second pulley member, the second pulley member comprising:

a corresponding second axle arranged to rotatably connect the second pulley member to a second bow limb of a compound archery bow, which second axle substantially defines a second rotation axis relative to the second bow limb;

a corresponding second draw cable journal non-rotatably mounted on the second axle and arranged to let out the draw cable as the bow is drawn and the second pulley member rotates about the second rotation axis;

a corresponding second power cable take-up mechanism arranged to take up the second power cable as the bow is drawn and the second pulley member rotates about its rotation axis; and a corresponding second power cable let-out mechanism for letting out the first power cable as the bow is drawn and the second pulley member rotates about the second rotation axis, wherein:

the corresponding second power cable let-out mechanism comprises corresponding paired let-out members positioned on the corresponding second axle so as to be disposed on opposite sides of the second bow limb; and the corresponding second power cable let-out mechanism is arranged so as to engage the first power cable in a split cable arrangement or a yoke arrangement engaged with the corresponding paired let-out members on opposite sides of the second bow limb.

23. The apparatus of claim 22 wherein the first and second pulley members assemblies are substantially identical or substantial mirror images of one another.

24. The apparatus of claim 22 wherein the first and second pulley members are arranged so as to avoid 100% let-off of the draw force or so as to prevent cocking of the bow.

25. The pulley member of claim 15 wherein the pulley member is arranged so that a ratio between a lever arm of the power cable take-up mechanism and a lever arm of the power cable let-out mechanism remains greater than 1:1 during let-out of the second power cable.

26. The pulley member of claim 15 wherein the power cable take-up mechanism comprises a power cable take-up journal.

27. An apparatus comprising a first pulley member and a second pulley member, wherein:

the first pulley member comprises (i) a first axle arranged to rotatably connect the first pulley member to a first bow limb of a compound archery bow, which first axle substantially defines a first rotation axis relative to the first bow limb, (ii) a first draw cable journal non-rotatably mounted on the first axle and arranged to let out a draw cable as the bow is drawn and the first pulley member rotates about the first rotation axis, and (iii) a power cable take-up mechanism arranged to take up a power cable as the bow is drawn and the first pulley member rotates about the first rotation axis;

the second pulley member comprises (i) a second axle arranged to rotatably connect the second pulley member to a second bow limb of the compound archery bow, which second axle substantially defines a second rotation axis relative to the second bow limb, (ii) a second draw cable journal non-rotatably mounted on the second axle and arranged to let out the draw cable as the bow is drawn and the second pulley member rotates about the second rotation axis, and (iii) a power cable let-out mechanism for letting out the power cable as the bow is drawn and the second pulley member rotates about the second rotation axis;

the power cable let-out mechanism comprises paired let-out members disposed on opposite sides of the second bow limb; and the power cable let-out mechanism is arranged so as to engage the first power cable in a split cable arrangement or a yoke arrangement engaged with the paired let-out members on opposite sides of the second bow limb.

28. The apparatus of claim 27 wherein the paired let-out members comprise a pair of power cable anchors that are eccentrically positioned relative to the second rotation axis so as to let out the power cable over at least a latter portion of drawing the bow.

29. The apparatus of claim 28 wherein the pair of power cable anchors are eccentrically positioned relative to the second rotation axis so as to take up the power cable over an initial portion of drawing the bow.

30. The apparatus of claim 28 wherein the second axle is arranged at its ends to serve as the pair of eccentrically positioned power cable anchors.

31. The apparatus of claim 30 wherein the second draw cable journal and the second axle are indexed to non-rotatably engage one another at a selected relative angular position.

32. The apparatus of claim 30 wherein the power cable anchors comprise anchor pulleys rotatably mounted at the ends of the second axle, each of which is arranged to receive and retain a corresponding looped end of a split power cable or a yoke cable.

33. The apparatus of claim 30 wherein the power cable anchors comprise eccentric, grooved end portions of the second axle, each of which is arranged to receive and retain a corresponding looped end of a split power cable or a yoke cable.

34. The apparatus of claim 27 wherein the first and second pulley members are arranged so as to avoid 100% let-off of the draw force or so as to prevent cocking of the bow.

35. The apparatus of claim 27 wherein the first pulley member is arranged so that a ratio between a lever arm of the first power cable take-up mechanism and a lever arm of the first power cable let-out mechanism remains greater than 1:1 during let-out of the first power cable.

36. The apparatus of claim 27 wherein the power cable take-up mechanism of the first pulley member comprises a power cable take-up journal.

* * * * *